US009616320B1

(12) United States Patent
Chekenian

(10) Patent No.: US 9,616,320 B1
(45) Date of Patent: Apr. 11, 2017

(54) INSTRUCTIVE BREAK SHOT TRAINING DEVICE

(71) Applicant: Anthony Thomas Chekenian, Henderson, NV (US)

(72) Inventor: Anthony Thomas Chekenian, Las Vegas, NV (US)

( * ) Notice: Subject to any disclaimer, the term of this patent is extended or adjusted under 35 U.S.C. 154(b) by 0 days.

(21) Appl. No.: 15/237,788

(22) Filed: Aug. 16, 2016

(51) Int. Cl.
*A63D 15/00* (2006.01)
*A63D 15/08* (2006.01)

(52) U.S. Cl.
CPC ..... *A63D 15/006* (2013.01); *A63D 15/00* (2013.01); *A63D 15/08* (2013.01)

(58) Field of Classification Search
CPC ..... A63D 15/006; A63D 15/00; A63D 15/08; A47C 7/36
USPC ..... 473/1, 2, 21, 26, 40, 41; 5/640
See application file for complete search history.

(56) References Cited

U.S. PATENT DOCUMENTS 574,351 A * 12/1896 Conner ..... A63D 15/00 473/44
694,463 A * 3/1902 Downey ..... A63D 15/06 473/32
1,143,222 A * 6/1915 Nathan ..... A63D 15/00 473/29
1,187,243 A * 6/1916 Bernstein ..... A63D 15/005 473/41
3,022,074 A * 2/1962 Grant ..... A63B 67/066 473/32
3,466,038 A 9/1969 Hill
3,618,944 A * 11/1971 Myers ..... A63D 15/005 473/41
3,704,887 A * 12/1972 Thorton ..... A63D 15/006 473/2
3,825,258 A * 7/1974 Frierman ..... A63D 15/00 473/2
4,103,773 A * 8/1978 Haber ..... A63D 15/005 473/41
4,120,494 A * 10/1978 Roe ..... A63D 15/006 473/2
4,183,523 A * 1/1980 Hecht ..... A63D 15/006 473/40
4,508,338 A * 4/1985 Kremski ..... A63D 15/06 473/32

(Continued)

FOREIGN PATENT DOCUMENTS

JP 2014226522 A * 12/2014 ..... A63D 15/00

*Primary Examiner* — Mitra Aryanpour

(57) ABSTRACT

Apparatus for billiards break shot practice, comprising a lightweight force absorption pillow and a triangle rack pattern combination. Game player breaks with maximum force to achieve greatest transfer to cue ball travelling to break up game balls, but using a reduced three-game-ball configuration with assistance of pillow and pattern that well-simulates virtually the same resistance of full fifteen-game-ball tournament game ball formation. A player saves tremendous time and effort in game ball setup and can practice break shots in rapid succession to develop high levels of breaking skill. Head and cue ball travel are observed in more iteration per practice session. The pillow has a storage flap to hold pattern, making it portable and quick to layout. Aligning pillow and pattern different distances apart simulates different ball resistances for game variations like 9-ball or 10-ball, or for different table sizes.

8 Claims, 4 Drawing Sheets

(56) References Cited

U.S. PATENT DOCUMENTS

| | | | | | |
|---|---|---|---|---|---|
| 5,183,254 | A * | 2/1993 | Jones | A63D 15/00 | 473/4 |
| 5,572,757 | A * | 11/1996 | O'Sullivan | A47C 7/46 | 5/640 |
| 6,053,817 | A * | 4/2000 | Fiegel | A63D 15/006 | 473/2 |
| 6,537,156 | B1 * | 3/2003 | Stagg | A63D 15/005 | 473/1 |
| 6,748,615 | B1 * | 6/2004 | Tiedemann | A47C 7/383 | 5/640 |
| 6,761,643 | B2 * | 7/2004 | Boatwright | A63D 15/006 | 473/2 |
| 6,860,816 | B2 | 3/2005 | Bond | | |
| 8,162,771 | B2 * | 4/2012 | Bergstrom | A63D 15/00 | 473/2 |
| 2003/0216188 | A1 * | 11/2003 | Boatwright | A63D 15/006 | 473/2 |
| 2012/0208651 | A1 * | 8/2012 | Bergstrom | A63D 15/00 | 473/2 |

* cited by examiner

INSTRUCTIVE BREAK SHOT TRAINING DEVICE

CROSS REFERENCE TO RELATED APPLICATIONS

N/A

NOTICE OF TRADEMARK

The word mark "Pro Break Trainer" and/or any other word, picture, or audio representation containing "Pro Break Trainer" or the like, is claimed as the trademark of Mr. Anthony Thomas Chekenian. Competition is hereby NOW ON NOTICE that the "Pro Break Trainer" word/phrase mark is considered the trademark of Mr. Anthony Thomas Chekenian, as of Jun. 15, 2016. All rights reserved. Application for trademark registration/protection is under USPTO serial number 87072532.

BACKGROUND

The parlor game of "pool," also often referred to as "billiards" and "pocket pool," is a well-known game of skill played by millions of persons around the world, and will hereinafter be referred to as the "game" in this application. The game consists of a series of steps in which a player uses a "cue stick" to propel a white or off-white, non-numbered cue ball to impact fifteen other numbered game balls, first racked tightly into a triangular configuration by a standard racking triangle frame, into pockets on a table designed specifically for this game, and includes a list of rules for play. There are recreational game players, as well as dedicated professional players from around the globe. This invention addresses specifically on the importance and difficulty practicing the first action of any new game, the all-important square hit of a "break shot," also commonly known as "breaking."

"Play Great Pool: The Definitive Textbook for Teaching Yourself the Sport of Pocket Billiards," written by the professional pool player and holder of the current prestigious post of the USA Mosconi Captain, Mark Wilson, notes the following important points about the central importance of a break shot and challenges presented in practicing them (emphasis added):

(1) The opening shot of each pool game is known as the break. In many games, your objective will be to powerfully strike the rack and drive one or more object balls into a pocket. To successfully achieve this objective, you will need both accuracy and power—the reason the break stroke [shot] is one of the most difficult shots in pool.

(2) Because it is difficult to combine extreme power with extreme accuracy, you must be willing to devote significant time to practicing.

(3) For a week before any important tournament, I would hire a "racker" to set up the balls for me, and practice nothing but breaking for 30 minutes every day for the entire week.[1]

[1]"Play Great Pool: The Definitive Textbook for Teaching Yourself the Sport of Pocket Billiards" by Mark Wilson, is available from Blue Book Publications, Inc., 2013, ISBN-13: 978-1936120376. The Masconi Cup is an annual pool tournament between the USA and Europe, and has been played since 1994. It grants an annual trophy named after an American Player named Willie Mosconi. This tournament has been compared to the Ryder Cup in golf (source cited: http://wikiwand.com/en/Mosconi_Cup).

Like Wilson states, the "break shot" requires a difficult combination of accuracy and power that requires a significant time practicing for competitive play. Also, the problem of potentially finding a "racker (helper)" to set up 15 balls for this "break shot" practice, or alternatively using a lot of the player's actual time and energy to setup a 15-ball rack of balls for practicing breaking, means any player of the game must spend an inordinate amount of time setting up the balls for doing a practice break shot session or be forced to employ others to repeatedly, efficiently, practice their break shots in a defined period of time. This essential need for practicing this critical game shot and the desire to have as many practice break shots done in an given of time, is a serious problem for any player of the game, considering the work to setup a full set of balls in a traditional triangular racks.

In addition to the problems in accomplishing successive practice break shots in practice sessions noted above, it must be noted that repeatedly practicing this break shot also provides a player with the ability to monitor and learn to control the probable cue ball positioning after the completed break shot motion, an essential for developing better play strategies. It also allows a player to practice doing an effective "choked-up" hand grip on their cue stick to maximize power and control in the shot.

Break practice allows the practicing player to see where the "head ball (often labeled #1)," the single ball positioned in the configured 15-ball triangle, which is the target of the break shot, travels after the break shot, as to know how this ball can be controlled even when doing a very powerful break shot. For example, the head ball may be above, below, or right into a side pocket, affecting numerous aspects of the game; one namely being if one or more of the non-cue balls other than the #8 ball go into a pocket the same player continues with further shots of the cue ball to continue on their turn. Knowing where the cue and the head balls seem to travel when perfecting a powerful and accurate break shot requires as many as possible practice breaks repetitions for observing trends of leaving balls in certain places, but most of all—overcoming the terrible problem of time used in re-racking all 15 balls of the game to know physical resistance exists like in any full pool game.

Information relevant to attempts to address these problems can be found in U.S. Pat. Nos. 3,466,038 and 6,860,816 B2, and Japanese Patent No. 2014226522A. However, each one of these references suffers from one or more of the following disadvantages:

(1) the apparatus claimed is very mechanically complex;

(2) the apparatus is made up of too many parts—making maintenance, failure, or its cost of production high;

(3) the device is too large for easy stowage or storage;

(4) the device is heavier than desirable for a game player;

(5) the apparatus is not very aesthetically appealing;

(6) the apparatus does not allow break shot practice as quickly as desirable by a player;

(7) the apparatus may be difficult for a novice to use.

(8) the equipment (apparatus) does not allow for the use of genuine object game balls in practice break shots.

(9) the apparatus may simply not be allowed in many pool halls by owners of these establishments because of a fear or high lack of confidence that the heavy equipment or hard component parts may damage the felt surface or other parts of a game table by regular use of the apparatus, improper use of apparatus, or extensive assembly and disassembly of the apparatus.

For the forgoing reasons, there is a need for a lightweight, easy to use, simple to transport training apparatus that allows for more break shot practices to be accomplished very quickly, requiring as little racking as possible, to develop a player's breaking skills by seeing their que and head ball travels in more iterations, without the use of any "racker" person assisting or spending inordinate amount of times assembling a 15-ball rack of balls over and over again, but accomplishing the same physical practice as a typical game's physical setup assembly.

SUMMARY

The present invention is directed to an apparatus for practicing break shots in a billiards or pocket-pool game that satisfies these needs to: 1.) eliminate or avoid the need for a "racker" helper; 2.) efficiently accomplish as many break shot practice motions as possible in a given period of time, 3.) monitor and learn to control the probable cue ball position after the break shot motion and control this cue's positioning after the break shot, and 4.) see where the "head ball" travels after the break shot and also this head ball's relative leave position. An apparatus having features of the present invention comprises a force absorption pillow and a ball holder device, that are not attached to each other, but aligned about 2.54 cm (1 inch) from a triangle back of the ball holder device and the impact front of the force absorption pillow. The force absorption pillow and the ball holder device are coplanar, used on the surface of a typical 9-ft billiards table, and setup as illustrated as in drawings, "FIG. 1, 3, or 6."

The present invention's force absorption pillow provides physical resistance equivalent to a 15-ball game set that is normally shot at in an in-game break shot, but the force absorption pillow performs the role with many fewer balls, such as just three used, plus this addition of the absorption pillow piece, but still using actual pool game balls. For example, a player may use three or six numbered game balls versus an entire game 15-ball set, and accomplish a simulation of the head ball and cue ball leave positions with "fewer balls acting as many." This resistance factor from the force absorption pillow means less tedious tight, re-racking/rearrangement work for the player of fifteen game balls after each break shot practice, eliminating the need to employ a "racker (helper)" or to spend as much time for the player physically re-racking for successive practice break shots. By simulating the full 15-ball rack with this force absorption pillow, there is a mechanism to shoot many more break shots per hour or fraction thereof. This force absorption pillow in the present invention has an impact front for ball collisions, an advertising back side (identical structure), a bottom surface, a filling compartment zipper, right and left side panel seams, a pillow filling, a left side strap, and a right side strap, and a storage flap attached to the bottom surface to store or transport the ball holder device.

The ball holder device of the present invention comprises nine ball position holes to align a rack of 15 game balls. It can make a 3, 6, 9, 10, or 15 ball setup quickly configured, and is seen without balls atop this pattern in FIG. 7. It has a set of two securing holes, to affix the triangle table rack pattern to a pool table at the "spot,[2]" using a securing sticker. This present invention ball holder device lies flat on the game table, and is 0.0254 mm-0.254 mm (1-10 mils) thick Mylar or a ridged plastic polymer, as to hold the balls, but yet not to inhibit quick motion upon strike of cue ball.

[2]The "spot" on a pool table is the metal or paper sticker dot indicating where the head pall is positioned in the triangular formation of balls.

These and other features, aspects, and advantages of the present invention will become better understood with reference to the following description and appended claims.

DRAWINGS

There are no color drawings in this application. Features, aspects, and advantages of the present invention will become better understood with regard to following description, appended claims, and accompanying drawings where:

DESCRIPTION

Figure 1:
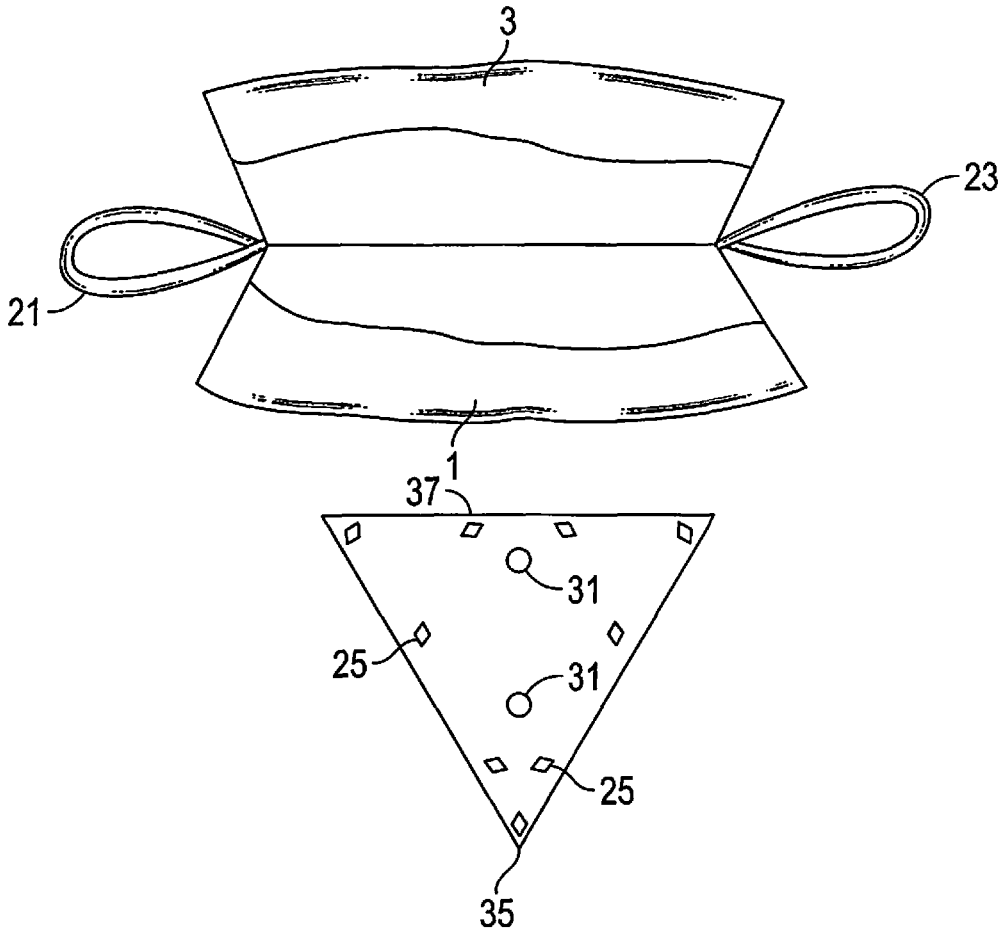
FIG. 1 shows an overhead view of an embodiment of the invention, as one would look down at the apparatus from directly above the embodiment.

In the summary above and description section here, and in the claims below, and in the attached drawings, reference is made to certain features of the invention. It is to be understood that the disclosure of the invention in this specification includes all possible combinations of such certain features. If a particular feature is disclosed in the context of a particular aspect or version of the invention, or in a claim, the feature may also be utilized in combination with and/or in the context of other aspects of the invention, and also in the invention generally.

The term "comprises," along with grammatical equivalents thereof means that other components are optionally present. For example, if an embodiment of the invention is comprised of A, B, and C, it can contain A, B, C and other components.

Where reference is made to a method comprising two or more defined steps, the defined steps can be carried out in any order or simultaneously (except where context excludes this possibility), and the method can include one or more other steps which are carried out before any of the defined steps, between two of the defined steps, or after all the defined steps (except where context excludes this possibility).

The term "at least" followed by a number is used to denote the start of a range beginning with that number (which may be a range having an upper limit or no upper limit, depending on the variable being defined). For example, "at least 5 mm" means 5 mm or more than 5 mm. The term "at most" followed by a number is used to denote the ending that number (which may be a range having 0 as its lower limit or a range having no lower limit, depending on the variable being defined). For example, "at most 20%" means 20% or less than 20%. If in this specification a range is given as "(a first number) to (a second number)" or "(a first number)-(a second number)," this means a range whose lower limit is the first number and upper limit is the second number. For example, a range of 5 to 30 mm means a range whose lower limit is 5 mm, and whose upper limit is 30 mm.

Definitions

A Cue Stick or Game Stick is a traditional game stick about 147 cm (58 inches) used in billiards (pool) or the cue sport of snooker. This stick is used to strike a "cue ball," transferring the force to this cue ball which then travels in a line to strike apart a formation of game balls.

"Cue ball" is a ball about 5.72 cm (2.25 inches) in diameter, used in the game of billiards, and is usually differentiated by a different color (white or off-white) from the fifteen numbered "game balls." It is typically made from phenolic resin, polymer, or polyester, but other variants of material, such as wood, can and do exist. On occasion, typically at certain commercial pool halls, a cue ball may be slightly larger in diameter than the "game ball(s)," for example a cue ball that is 6.35 cm (2.5 inches) in diameter. Note: "Game balls," also referred to as "object balls, are defined in the proceeding paragraph. This minor size difference in this context aids in mechanically channeling a cue ball to a retrieval chamber when a player "scratches," meaning the cue ball is shot (on a break shot) into a table pocket or doesn't hit any game balls at all (a "scratch" is a type of foul). In a game, the "cue ball" is struck by a cue stick and the travels toward the numbered game balls. In this patent application, the "cue ball" is not a "game ball," but a ball that is used in the game of billiards.

"Game ball(s)," also alternatively referred to as "object ball(s)" or "genuine object ball(s)s" is/are the numbered balls racked in formations to start a billiards game. These "game balls" are 5.72 cm (2.25 inches). These balls, like a "cue ball" is/are typically made from phenolic resin, polymer, or polyester, but other variants of material, such as ivory or wood do exist.

Billiards table or a "pool table" is a table with ball pockets, traditionally used for the game of billiards (pool). These tables vary in length, from about 2.13 m to 2.74 m (7 to 9 feet), and corresponding widths from about 1.07 m to 1.37 m (3.5 to 4.5 feet), about half the width to length. The table is covered in a felt fabric.

"Force absorption pillow" or "pillow" is the element of the invention comprising a fabric pillow as shown in FIGS. 1-6. It is filled with lightweight pillow filling material chosen from a group consisting of buckwheat, millet, flaxseed, a plastic polymer, down feathers, hazelnut shells, hemp, wool, polyester, polystyrene beads, horsehair, or natural shredded rubber.

"Impact front" is the side of the "force absorption pillow" shown in label 1 of the drawings, and labeled as such because it is a neutral, solid color to avoid distraction of the game user, in contrast (of color and artistic design) with the "advertising back," defined below in label 3 of the drawings. These two labeling of these two identically-sized faces of the force absorption pillow are important for understanding the right and left orientations of other component parts of the invention. The impact front is the part of eth pillow that the game balls strike. Here it simulates the resistance of an entire set of fifteen "game balls."

"Advertising back" is the side of the "force absorption pillow" shown in label 3 of the drawings. This back is designed for pillow esthetics, equivalent in size to the "impact front," but also to provide an area for a logo or a design. A game player using the invention will not see this side of the advertising back when breaking, but provides utility and practical advertising space.

"Bottom Surface" or "fabric nap" is the table-facing side of the force absorption pillow shown in label 5 and 7 of the drawings. It is made of a courser fabric than the rest of the force absorption pillow, to aid in traction of the pillow to the pool table felt surface.

"Filling Compartment Zipper" is the zipper entry to the inside of the pillow, used to fill the pillow with a "pillow filling" as described in the definition of "pillow filling" below. It can be any variety of zippers, but must not impede the bottom surface of the force absorption pillow to lie flat on the pool table.

"Right side seams" are the three pillow stitching seams denoted by label 13 of the drawings. The "right side strap (label 21)" defined below is sown tightly into one of these three seams. Note that the orientation of the left and right of seams and straps is dictated by one facing the "impact front."

"Left side seams" are the three pillow stitching seams denoted by label 11 of the drawings. The "left side strap (label 23)" defined below is sown tightly into one of these three seams. Note that the orientation of the left and right of seams and straps is dictated by one facing the "impact front."

"Inner surface" is the inside of the force absorption pillow that touches and holds the "pillow filling" described in its definition below.

"Pillow filling" is the bulk of the weight of the force absorption pillow, which can be removed or added via the filling compartment zipper defined above. This pillow filling is a material chosen from a group consisting of plastic material mimicking or the natural material of the following: buckwheat, hazelnut shells, down feathers, millet, flaxseed, hemp, wool, polyester, polystyrene beads, horsehair, or shredded rubber.

Figure 2:
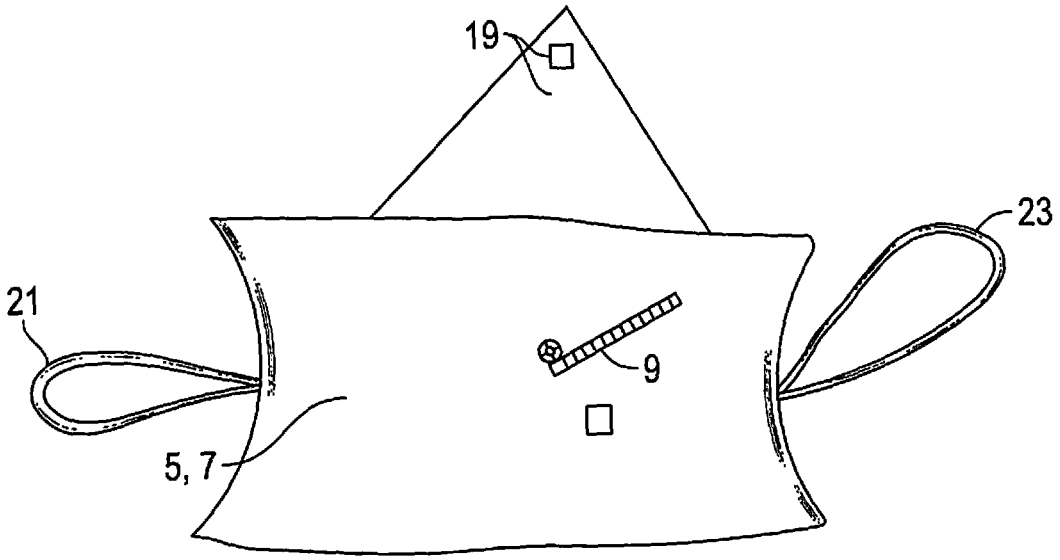
FIG. 2 shows the bottom surface of an embodiment of the invention in the force absorption pillow component, the filling compartment zipper, left side strap, right side strap, Velcro "hoop and loop" fastener set.

"Storage Strap" or "storage strap with hook and loop fastener" is a triangular flap of fabric which is about one-half the length of the bottom surface and about three-quarters the width. It is attached (sewn into) to the lengthwise portion of the bottom surface. It is stitched lengthwise on this bottom surface, as close as possible to impact front, but still on the bottom surface. This storage strap work to hold the ball holder devices components firm against the bottom surface for compact towing on the combination apparatus. This strap is secured by stitching at one side of the triangle, and at the tip of the opposing end, and hook and loop fastener system, as shown in FIG. 2, label 19 and on the right-hand side of the bottom surface, label 5. This system is made from synthetic materials that adhere when pressed together, commonly sold under the trademark "VELCRO," a hook and loop fastener system.

"Left side strap" is a circular loop strap that is sewn into one of the three left side seams. It is made of a lightweight fabric such as cotton or wool, or may be made of plastic, rubber, or light alloy chain link materials. The full length of the loop is between 2.54 and 63.5 cm (1 and 25 inches), and is shown in label 21 of the drawings. Note that in drawings such as FIG. 3, there is a transparent plastic used, thus showing to the naked eye structure of the force absorption pillow beneath it.

"Right side strap" is the circular loop strap with opposition orientation to the "left side strap," sewn into one of the "right side seams." It is otherwise identical the "left side strap" in the attributes listed above in the corresponding "left side strap definition.

"Triangle rack pattern" or "pattern" is the first of two primary parts of the ball holder device. It is shown with the securing stickers in FIG. 7, but it is distinct from the set of two securing stickers shown affixed to it there in this drawing. The term "tethering mechanism" means the set of two securing holes and the set of two securing stickers used to hold the pattern to a billiards or pocket-pool table. This pattern is very thin, and can be about 0.0254-0.254 mm (1-10 mils). Thicker or thinner gauges can be used with more ridged plastics. However, the synthetic plastic material in plastic film, commonly sold under the brand name "Mylar" is presently used for this pattern. This plastic material is also generally known as BoPET or biaxially-oriented polyethylene terephthalate.

Figure 7:
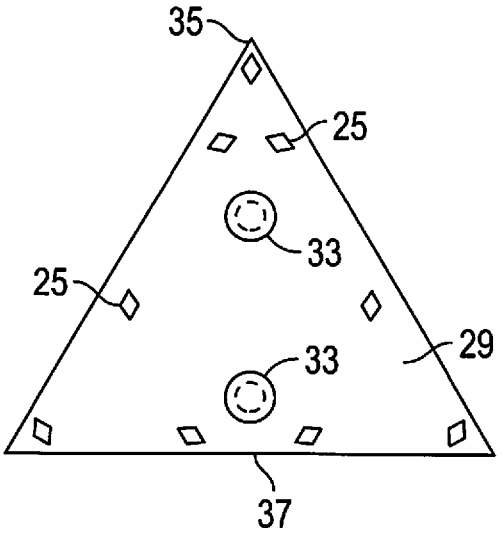
FIG. 7 shows a close-up view of an embodiment of the invention in the ball holder device, showing this embodiment's set of nine ball positioning holes, a triangular top surface, a triangle tip, a triangle back, and a securing sticker set.

"Set of nine ball positioning holes" or "ball positioning holes" is shown in drawing FIG. 7, label 25. These holes are diamond shaped, circular, or square, but allow enough contact to hold the game balls in a neat, tightly-racked, traditional 15-ball triangular pool rack configuration with object balls touching each other without any interstitial spaces; or in the tip of triangle, the three holes closest to label 35 of FIG. 7, will keep a small 3-ball group as close as possible together. Either configuration allows a critical, necessary tight racking of the game balls (Note: Game balls are in a 15-ball configuration are successive rows of 5 balls, 4 balls, 3 balls, 2 balls, and then 1 ball). As an important side note, it is imperative that game balls are tightly racked so there is no interstitial space(s). In tournament and non-tournament play, it just cannot be emphasized enough how important it is that the object balls are touching each other as tightly as can be achieved. Furthermore, while to a novice this tight racking may appear easy to achieve, tight racking is a developed skill, and takes practice to perform well. In tournament matches, opponents rack for each other, and the player who is breaking gets an opportunity to confirm he or she has been given a proper, tight racking of the game balls by their opposing player. If any "Loose Racking" (also called "slugging") occurs, the racking opponent will have to re-rack the balls for their breaking opponent. Loose racking sometimes occurs by racking opponents because it gives a disadvantage to the breaking player and an advantage to the racking player—loose balls won't allow proper force dispersion for achieving maximal movement of the game balls. While not termed as "loose racking (slugging)," sometime players may also improperly make one or two of the three leading game balls (closest to breaking player) touching, but one or two other balls are loose—this is a form of cheating because it also brings an element of unfair advantages in ball control versus a uniformly tight racking of all of the game balls.

"Pattern bottom surface" is the bottom of the pattern that contacts the table. It must lie flat against the table to allow for uniform ball contact with a rack of 15 or 3 balls.

"Pattern top surface" is the upward facing side of the pattern that game balls are positioned upon, and the set of two securing stickers are placed covering the set of two securing holes (both defined below).

"Set of two securing holes" or "securing holes" are the holes in the pattern shown in dotted lines in FIG. 7, and are the holes which allows the set of two securing stickers defined below allow the pattern to stay fixed on the table for successive quick break shot trails and resents of the practice 3-ball configuration.

"Set of two securing stickers" or "securing stickers" are the two slightly larger diameter (relative to the securing holes) that allow for affixing the pattern to the pool table felt securely. While holding to the felt, the game player may still easily remove the pattern, but it affixes the pattern effectively for successive iteration of ball traffic on and around it.

"Pattern tip side" or "tip side" is the pointed part of the pattern that faces the practicing game player. It is shown in FIG. 1's overhead view, label 35. This label distinguishes the tip side of the pattern from the impact-front-facing "pattern back side" defined below.

"Pattern back side" or "back side" is the flat part of the pattern that faces various distances from the impact front when used on a pool table. It is between and 2.54 and 12.2 cm (1-5 inches) from the impact front when used on a pool table.

Overview

As shown in FIG. 1 from above, the invention, at the high level, is a combination of a pool ball holder device pattern and a force absorption pillow used to simulate a full racking of game balls using less game balls (three), and avoids the steps of extensive re-racking of more game balls to do an instructive break shot exercise. It saves immense time for a practice break shot player with less movement to simulate a game ball formation to see head and cue ball travels, as noted extensively in the background of this application.

Figure 3:
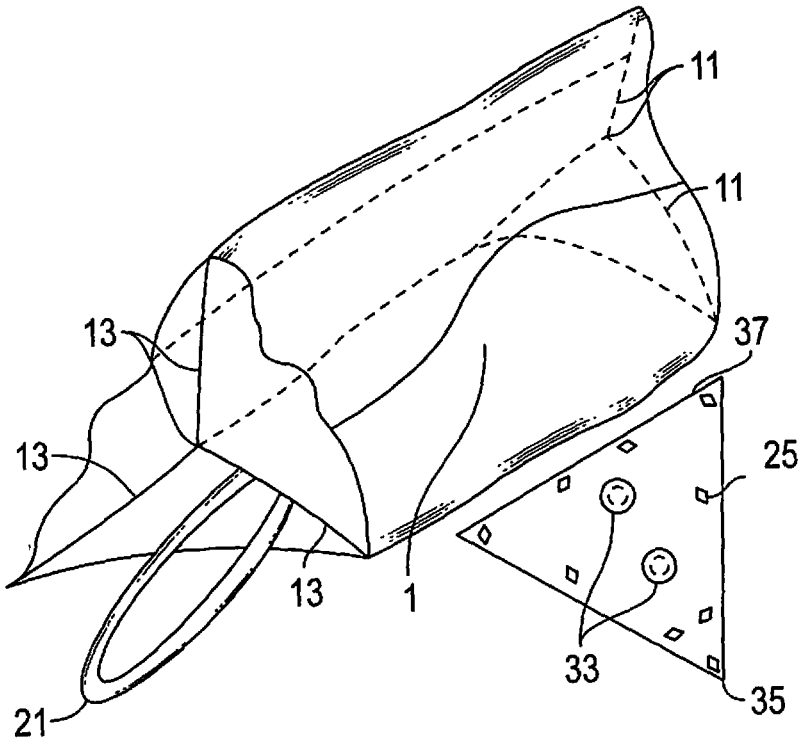
FIG. 3 shows a side view of an embodiment of the invention, allowing one to see the left side seems, left side strap, impact front, and ball holder device with detail of this ball holder device component of embodiment's detail of it's securing sticker set of two and ball positioning holes.
Figure 4:
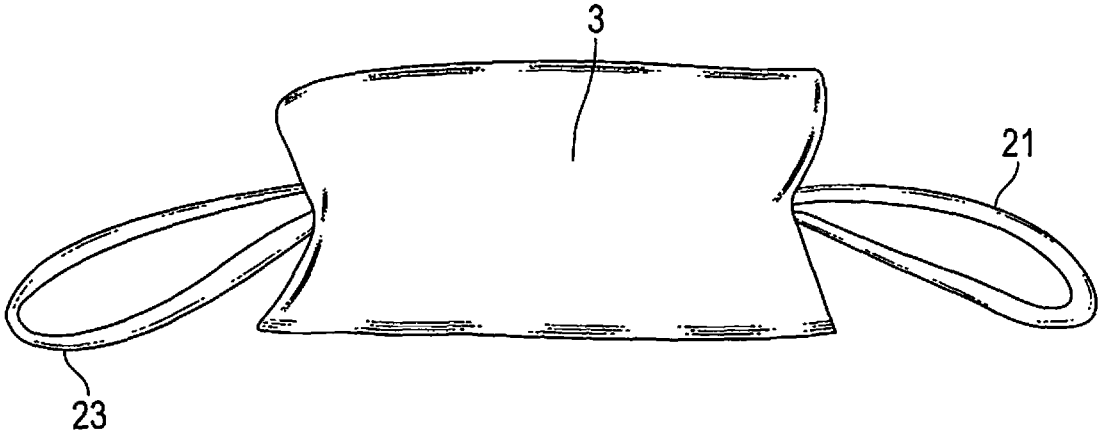
FIG. 4 shows a back view of an embodiment of the invention, the "advertising back."
Figure 5:
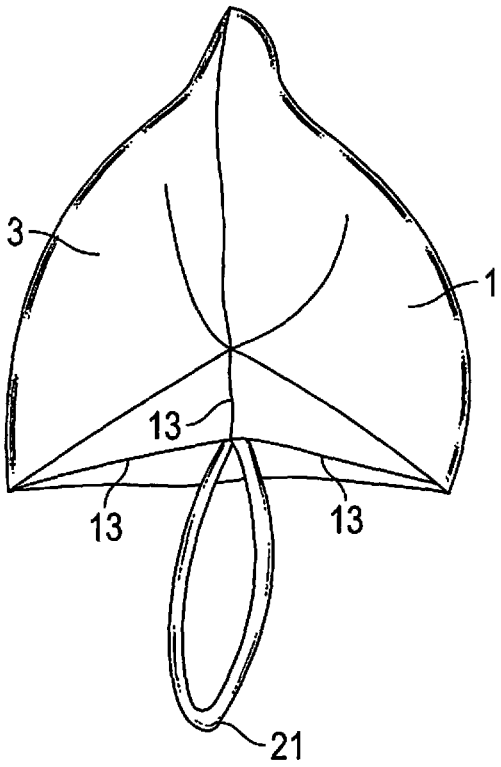
FIG. 5 shows a side view of an embodiment of the invention from an angle between that of above and from the left side of the embodiment, between these to two points of a top view and a side view angle.
Figure 6:
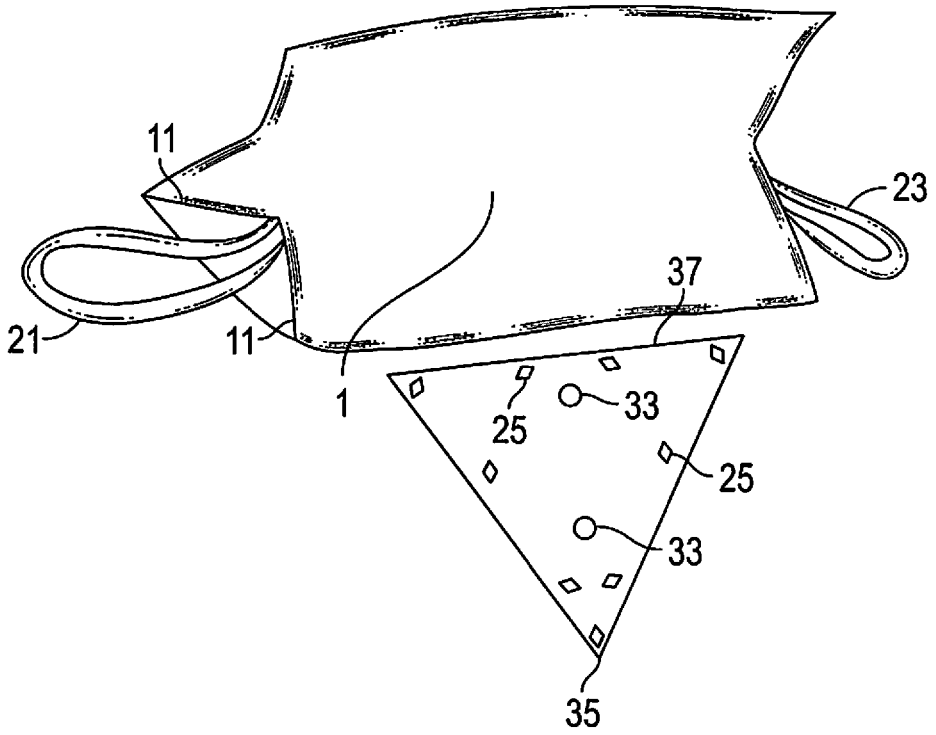
FIG. 6 shows a front view of an embodiment of the invention, as a break shot practicing player would see the version of the invention when doing breaking down a pool table.

As shown in FIG. 3, label 33, the set of two securing stickers, physically applied over the set of two securing holes, holds the pattern for affixing the pattern to the pool table felt for successive uses of practice shots without any of the repositioning normally associated with re-racking a full 15-ball or even the reduced 3-ball setup of game balls, other than simply setting back three game balls fast onto the ball positioning holes located on the pattern.

The pillow is the physical barrier that withstands the force of game balls game balls in a reduced three ball practice configuration of: row 1 with 1 ball and row 2 with 2 game balls, totaling 3 game balls. Seeing where the head ball and the cue ball move is a matter of having the pillow on the table behind the plastic film to accept the force when this practice configuration is broken. When struck by the cue or the three game balls used here in the invention, the pillow moves slightly backward from the force but does not leave the pool table, it merely shifts back slightly on the game table felt, the furthest back to the raised rail of a pool table. The fabric nap insures adequate friction between bottom surface and the pool table to keep the pillow close to its original positioning. Furthermore, the pillow keeps the three balls used for practice break shots close to the pattern, for a simple grab to put the three ball layout back together onto the pattern and to shoot another practice break shot almost immediately after the last one was completed. No repositioning of the pattern, pillow, or anything else—grab the three balls, replace them on the ball positioning holes, grab the cue ball and go to the other end of the table to shot a break once again. The player then observes the results of several break trials by doing this repeatedly in a more efficient break practice session.

The degree of closeness (shown in FIGS. 1, 3, and 6; between label 1 and 37) between the pattern back side and the impact front is typically about 2.54 cm (1 inch), but is easy to adjust for varying conditions, like a shorter pool table or even availability of pillow fillings. Also some players may choose to have different pillow filling to allow for almost no movement of the pillow (most force absorbed by pillow).

As shown in FIG. 2, portability and fast movement of the pillow is achieved by having side straps (left and right), to put the pillow in position on the table with ease, or to travel with it. In this version of the invention, the apparatus weighs about 0.650 Kg (1.43 lbs.) total, plus or minus about 10% depending on the particular pillow filling chosen. In other invention versions with heavier fillings and fabrics, the apparatus could be up to a top range of about 2.27 Kg (5 lbs.). The pillow filling (using filling compartment zipper) of horsehair, hazelnut shells, or buckwheat, is only a small fraction of total weight. As noted prior in this application, this is why this invention is an improved device meeting the need for a better break shot practice tool. The storage flap with a hook and loop fastener system the pattern and securing stickers can be held against the bottom surface of the pillow for an all-in-one unit to carry along to a pool tournament.

DETAILED DESCRIPTION OF THE ELEMENTS

The preferred embodiment of the invention is to construct a pillow of cotton, cotton synthetic blend, burlap, leather, faux leather, jean, or any other common fabric with a pillow filling comprised of buckwheat, millet, flaxseed, hemp, wool, polyester, polystyrene beads, horsehair, shredded rubber, or synthetic equivalents; to be about 20.3 cm (8 inches) wide, 35.6 cm (14 inches wide), and 15.24 (6 inches) tall, tapering down from the apex of the pillow to the width of the bottom of the pillow in a triangular fashion, as shown in FIG. 3. This pillow has two fabric handles attached to respective left and right side seams as shown in FIGS. 1, 2, 4 and 6. This size of pillow, with at least a set of three side seams on each end, fits most of the popular sizes of pool table with space on each side of it of about 50.8 cm (20 inches) (between each side pillow side and the side rail of the table) when centered widthwise with the table which allows ball flow to all pockets, and is to be positioned relative to the triangle table rack pattern, a fabricated, light plastic film triangle of 17.78 (7 inches) on each side as shown in FIG. 7. This pattern has several holes shown with relative sizes and positions as in FIG. 7, and is affixed to the pool table by using set of securing holes and larger paper 1-side stick securing stickers that cover the set of two securing holes and also adhere to the fabric of the pool table, and with the ball positioning hole closest to the pattern tip side, (tip side is label 35 of the drawings) directly over the "spot" of the pool table, and the pattern's back side parallel to the end of the pool table (the width of the rectangular pool table). The pillow is then placed about 2.54 cm (1 inch) from the pattern back side, and the pillow is positioned parallel to this well-positioned pattern.

A player takes three authentic game balls (regulation size balls used in a game or tournament, not a faux ball of any kind), and sets them with the ball positioning hole closest to pattern tip side, nearest label 35. The player backs up to the other side of the table opposite the apparatus and furthest away from the "spot," and forcefully strokes a cue stick to strike a cue ball and which impacts the head ball aligned closest to the pattern tip side. The player then observes the head and cue ball travels and adjusts his or her style, force, or position of shot to better position these balls in the next break shot. The player grabs the four balls, repositions them quickly and does another practice break. This happens as quickly and as rapidly and player desires.

The storage flap, sewn to the bottom of the pillow, allows the player to stow the pattern and a small sheet of stickers, and is a triangle (as shown in FIG. 2, label 19). This flap is about the same size as the pattern. When the pattern is stowed using the Velcro or other alternative fasteners noted in the alternative section below, the pattern is orientated directly below the flap, or slightly tilted so the Velcro a hook and loop fastener system or other alternative fastener can affix the strap to the bottom surface of the pillow. Regardless of the angling, the stickers and pattern stay taught against the bottom surface of the pillow.

The filling compartment zipper allows for a player use different types of pillow fillings, or supplement or replace the pillow filling when worn or damaged. There is a possibility that the set of securing stickers will hold an amount of adhesive over time wherein new ones won't be necessarily placed on the pattern but for every few weeks.

How the Invention is Used:

This invention is used by placing the pillow and pattern on a pool table in the proper places and completing repeated break shots using three game balls, a cue ball, and a cue stick. The pattern should be secured with the two securing stickers so the head ball is positioned on "the spot" first, then the force absorption pillow is placed about one inch behind the pattern back side, as in FIG. 3 and FIG. 6. Three game balls are placed at the ball positioning holes closest to the pattern tip side shown in FIG. 3, label 35. The player "breaks" the three game ball configurations by firing the cue ball from the other side of the table opposite the invention apparatus using a cue stick that transfers energy to the cue ball that ideally hits the head ball on the apex of the pattern tip side. The four balls travel, showing head and cue ball positions after the shot, but the two game balls behind the head don't travel as far as they have forces in their trajectories ultimately absorbed by the pillow, making them easier to quickly grab.

Advantages

As noted in the background section, the fewer parts to this invention, simpler construction, and lightweight nature of this invention, all make it advantageous over previous attempts to make more break shots in a given practice period and also learn about where the head and cue ball travel during a break shot. This apparatus is easy to store and carry to pool halls or tournaments, and its pillow can be compressed like any other pillow without damage. It is also more durable—it could be thrown onto a pool table or tossed into the back seat of a car.

In the immediately above subsection, entitled "HOW THE INVENTION IS USED," further demonstrates how fast the apparatus is setup or broken down—the player simply places the pattern on the table "spot" with the set of two securing stickers, positions the pillow, sets three balls, and takes the cue stick and cue ball to fire away. After the shot, the user notices ball positions. Repeat by placing the three game balls, then fire a break shot again. This could happen within a fraction of a minute for each shot. The dynamics of so few setup steps and component parts versus the highly mechanical setups of the patents mentioned in the background section give a clear advantage in time savings and work for a practicing player.

Alternatives

Although the present invention has been described in considerable detail with reference to certain preferred versions thereof, other versions are possible. For example, see I-IV below the proceeding the first four paragraphs of this subsection. Therefore, the sprit and scope of the appended claims should not be limited to the description of any preferred versions contained herein.

The reader's attention is directed to all papers and documents which are filed concurrently with this specification and which are open to public inspection with this specification, and the contents of all such papers and documents are incorporated herein by reference.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example only of a generic series Any element in a claim that does not explicitly state "means for" performing a specified function, or "step for" performing a specific function, is not to be interpreted as a "means" or a "step" clause as specified in 35 U.S.C. 112, ¶6. In particular, the use of "step of" in the claims herein is not intended to invoke the provisions of 35 U.S.C. 112, ¶6

I. Alternative bottom surfaces—rather than using a fabric nap which provides traction, a heavier of lighter fabric of cotton, polyester, wool, rayon, or other common fabric, a plastic material, a metal allow plate, or other pliable or non-pliable material may be employed.

II. Use of an internal weight—rather than (or in addition to) using a nap fabric, a small weight of 0.25-2 Kg (0.55-4.4 lbs.) can be used to keep the pillow in one spot. This weight would be placed inside the pillow.

III. Various additional handles & associated fasteners—On the top of the pillow, a carrying handle of fabric, plastic, or light metal alloy such as aluminum, in alternative or addition to side straps. Also, the side straps may attached by a button or be a clip mechanism (detachable) making it possible to have no protruding straps on the side of the pillow while in use during break practicing.

IV. Pillows with less or more seams—As pillows can have more or less seams depending upon the fabrication of a pillow, and alternative pillow could have more or less seams than described in this application's written description, "detailed description of the elements."

What is claimed is:

1. An instructive break shot training device comprising:

(a) a three-dimensional force absorption pillow with a front, a back, two sides, a bottom, and a mass to withstand the force of traveling game balls; and (b) a thin film with a plurality of holes that holds game balls tightly together with minimal interstitial space, and is placed at a predetermined distance from said pillow; and wherein said pillow and said film are placed together to allow for a reduced three game ball configuration to be used for rapid and repeated break shots and observe resultant head and cue ball travels.

2. The device as in claim 1, further comprising a means for securing said thin film to a game table surface.

3. The device as in claim 1, wherein said pillow is hollow and filled with a material chosen from a group consisting of buckwheat, hazelnut shells, down feathers, millet, flaxseed, hemp, wool, polyester, polystyrene beads, horsehair, natural shredded rubber, a synthetic fiber mimicking hazelnut shells, a synthetic fiber mimicking down feathers, a synthetic fiber mimicking millet, a synthetic fiber mimicking flaxseed, a synthetic fiber mimicking hemp, a synthetic fiber mimicking wool, a synthetic fiber mimicking horsehair, and a synthetic fiber mimicking natural shredded rubber.

4. The device as in claim 1, further comprising a left side strap and a right side strap.

5. The device as in claim 1, wherein said pillow bottom is made from a nap fabric able to inhibit pillow movement on a game table surface.

6. The device as in claim 1, wherein said pillow is hollow and has a zipper of sufficient size for inserting a filling.

7. The device as in claim 6, wherein said pillow further includes a storage flap that firmly holds said thin film to said pillow.

8. The device as in claim 1, wherein said back of said pillow includes an advertisement.

* * * * *